United States Patent [19]

Cassidy

[11] Patent Number: 5,073,090

[45] Date of Patent: Dec. 17, 1991

[54] FLUID PISTON COMPRESSOR

[76] Inventor: Joseph C. Cassidy, 05750 Canary Road, West Lake, Oreg. 97493

[21] Appl. No.: 478,921

[22] Filed: Feb. 12, 1990

[51] Int. Cl.[5] ..... F04F 11/00

[52] U.S. Cl. ..... 417/102; 417/103

[58] Field of Search ..... 417/92, 101, 102, 103

[56] References Cited

U.S. PATENT DOCUMENTS

| | | | |
|---|---|---|---|
| 1,203,335 | 6/1915 | Hill | 417/102 |
| 1,766,998 | 6/1930 | Jacocks | 417/102 |
| 2,277,977 | 3/1942 | Hesse | 417/102 |
| 2,549,620 | 4/1951 | Mitchell | 417/102 |
| 3,891,352 | 6/1975 | Tsukamoto | 417/101 |
| 3,907,462 | 9/1975 | Kroeger | 417/102 |
| 4,265,599 | 5/1981 | Morton | 417/101 |
| 4,566,860 | 1/1986 | Cowan | 417/102 |

*Primary Examiner*—Richard A. Bertsch
*Assistant Examiner*—Michael I. Kocharov
*Attorney, Agent, or Firm*—Chernoff, Vilhauer, McClung & Stenzel

[57] ABSTRACT

A compressor utilizes a fluid piston to achieve high volumetric efficiency and produce moisture-free, clean, compressed fluid. The compressor has two hollow chambers which are interconnected by a conduit system having a pump located in it. The compressor contains a sufficient volume of noncompressible transfer fluid to completely fill one of the cylinders and the conduit system. A switching system causes the pump to pump the transfer fluid into a first chamber until that chamber is completely filled and then pump the transfer fluid out of the first chamber and into the second chamber. When the second chamber is completely filled the switching system again causes the direction the transfer fluid is being pumped to reverse and the cycle is repeated. Compressible fluid inlets located in the chambers permit compressible fluid to be drawn into a chamber when transfer fluid is being pumped from it, and compressible fluid outlets permit fluid that is compressed when transfer fluid is pumped into a chamber to be pumped out of the chamber. A storage tank fluidly connected to the compressible fluid outlets collects and stores the compressed fluid generated by the compressor. A heat exchanger located in the conduit system cools the transfer fluid as it is pumped between the chambers. A bleed system reduces the volume of transfer fluid in the compressor whenever it exceeds the desired volume by a predetermined amount as a result of its absorbing moisture that is condensed out of the fluid being compressed.

3 Claims, 4 Drawing Sheets

FLUID PISTON COMPRESSOR

BACKGROUND AND SUMMARY OF THE INVENTION

This invention relates to a compressor, and its method of operation, in which a noncompressible fluid is pumped back and forth between a pair of chambers to compress a source of compressible fluid.

Compressors are used in many different applications. The most common type of compressor is the air compressor which compresses atmospheric air. However, other fluids are commonly compressed, such as refrigerant in a refrigeration system. Compressors come in many sizes and shapes, depending on the fluid being compressed and the pressure and volume requirements, however, all prior art positive displacement compressors use solid elements to compress the fluid. The use of solid elements to affect compression limits the compressor's efficiency, makes it complex, and results in high maintenance costs. In addition, with compressors using solid compression elements it is difficult to prevent oil, microscopic particles, and water from ending up in the compressed fluid.

Two factors limit the volumetric efficiency of compressors using solid compression elements. First it is necessary to maintain some clearance between the solid element and the structure against which it compresses fluid so that they will never come into contact with one another due to thermal expansion, even under the most severe operating conditions. Thus, a portion of the cylinder volume necessarily is not utilized during compression. Second, compression of fluid causes its temperature to increase, and heat then is transferred from the fluid into the parts of the compressor, such as the piston head, the compressor chamber walls, and the chamber head, which surround the fluid. Thus, the temperature of these parts increases also. Then when new fluid is drawn into the compressor it is heated by those hot compressor parts which causes the fluid to expand and become less dense. Thus, less fluid is available for compression and the volumetric efficiency is reduced. Because of this phenomenon, compressors typically are cooled in one fashion or another. However, with a compressor that uses a solid compression element, such as a piston, this element is usually buried in the compressor and is difficult to cool.

In addition, air, and other compressible fluids, typically contains moisture, and when the fluid is compressed this moisture condenses out. Because compressors with solid compression elements pass whatever is drawn into them back out in the compressed fluid, moisture must be removed from the compressed fluid by passing the fluid through a drier. This not only is expensive but adds to the complexity of the compressor and of its operation. In addition any microscopic particles of material which are too small to be removed by filtering remain in the compressed fluid.

Furthermore, the majority of compressors require lubrication, and with compressors using solid compression elements lubricating oil will adhere to the compression element and be thrown off of it during operation of the compressor, resulting in oil in the compressed air. This is particularly true with reciprocating piston compressors where there is rapid deceleration of the piston at the top of each stroke which causes oil to be thrown into the compressor outlets where it is easily entrained in the compressed fluid as the fluid flows through the outlets at a high rate of speed.

Another shortcoming of many prior art compressors, and in particular with piston compressors, is that when they are stopped mid-stroke, partially compressed fluid must be bled from the cylinder before the compressor is restarted. As a result the energy that went into this partial compression is lost. In addition, for reasons of safety, health, and environmental protection, many gases cannot be expelled into the atmosphere. Thus, the expelled gas must be contained by add-on equipment and re-introduced into the compressor at an obvious premium in original cost and maintenance cost.

Finally, compressors having solid compression elements typically have many moving parts, most of which are subject to high loading. Thus, they are expensive to build and maintain. In addition, they require periodic maintenance which causes the compressor to be out of service for extended periods of time on a regular basis.

The subject invention overcomes the foregoing shortcomings and limitations of compressors having solid compression elements by fluidly interconnecting a pair of hollow chambers through a conduit system. A noncompressible transfer fluid fills one of the chambers and the conduit system, and a pump located in the conduit system is used to pump the transfer fluid back and forth between the chambers. A switching system, associated with the conduit system, causes the pump to pump transfer fluid into a first one of the chambers until that chamber becomes completely filled, and then pump transfer fluid from the first chamber back into the second chamber until the second chamber becomes completely filled. This cycle is repeated during the operation of the pump.

Each chamber has a compressible fluid inlet through which compressible fluid is drawn into the chamber when transfer fluid is being pumped out of it, and a compressible fluid outlet through which compressible fluid is discharged from the chamber as the chamber is filled with the transfer fluid. One-way valves, located in the compressible fluid inlets and outlets prevent the compressible fluid from flowing through them in the reverse direction. A storage tank that is fluidly connected to the compressible fluid outlets receives and stores the compressed fluid. A heat exchanger located in the conduit system cools the transfer fluid as it is being pumped between the two chambers.

In a preferred embodiment of the invention, the conduit system includes a first conduit that extends between the first chamber and the pump outlet, and has a first valve located in it. A second conduit, having a second valve located in it, extends between the pump inlet and the second chamber. In addition, a third conduit extends between the second chamber and the pump outlet and a fourth chamber extends between the pump inlet and the first chamber. The third conduit has a third valve located in it, and the fourth conduit has a fourth valve located in it.

The switching system includes a first level sensor that is located at the uppermost level of the first chamber, and a second level sensor that is located at the uppermost level of the second chamber. The level sensors are activated whenever their respective chambers are filled with transfer fluid. The level sensors are connected to a microprocessor that is programmed to open the first and second valves and close the third and fourth valves when the first level sensor is activated, and close the first and second valves and open the third and fourth valves when the second level sensor is activated. Thus, the direction of transfer fluid flow through the conduit system automatically reverses each time one of the chambers is filled.

The invention also includes a bleed system that removes excess transfer fluid from the compressor whenever it overfills as a result of absorbing water that condensates out of the fluid as it is compressed. In the preferred embodiment, the bleed system includes a third level sensor, that is located a predetermined distance above the bottom of the second chamber. The third level sensor is activated whenever the transfer fluid fills the second chamber to this predetermined level. A bleed outlet, located in the bottom of the second chamber, has a fifth valve located in it. The fifth valve, which is normally closed, is opened by the microprocessor whenever the first and third level sensors are simultaneously activated. The microprocessor is programmed to close the fifth valve again when it has been open for a predetermined time interval. During this time interval, transfer fluid is pumped out of the conduit system through the bleed outlet as it is pumped out of the first chamber and into the second chamber.

Accordingly, it is a principal object of the subject invention to provide a compressor that uses noncompressible transfer fluid as its piston.

It is a further object of the subject invention to provide such a compressor in which the entire volume of the compression chamber is utilized to compress fluid on each stroke.

It is a still further object of the subject invention to provide such a compressor in which the transfer fluid is cooled outside of the compression chambers between every stroke.

It is yet a further object of the subject invention to provide such a compressor in which partially compressed air does not have to be bled out of the chamber in order to restart the compressor, when it is stopped in mid-stroke.

It is a still further object of the subject invention to provide such a compressor which automatically removes moisture that condenses in the compressible fluid during compression.

It is a further object of the subject invention to provide such a compressor in which microscopic particles in the air being compressed are removed during compression.

The foregoing and other objectives, features and advantages of the present invention will be more readily understood upon consideration of the following detailed description of the invention taken in conjunction with the accompanying drawings.

PREFERRED EMBODIMENT

Figure 1:
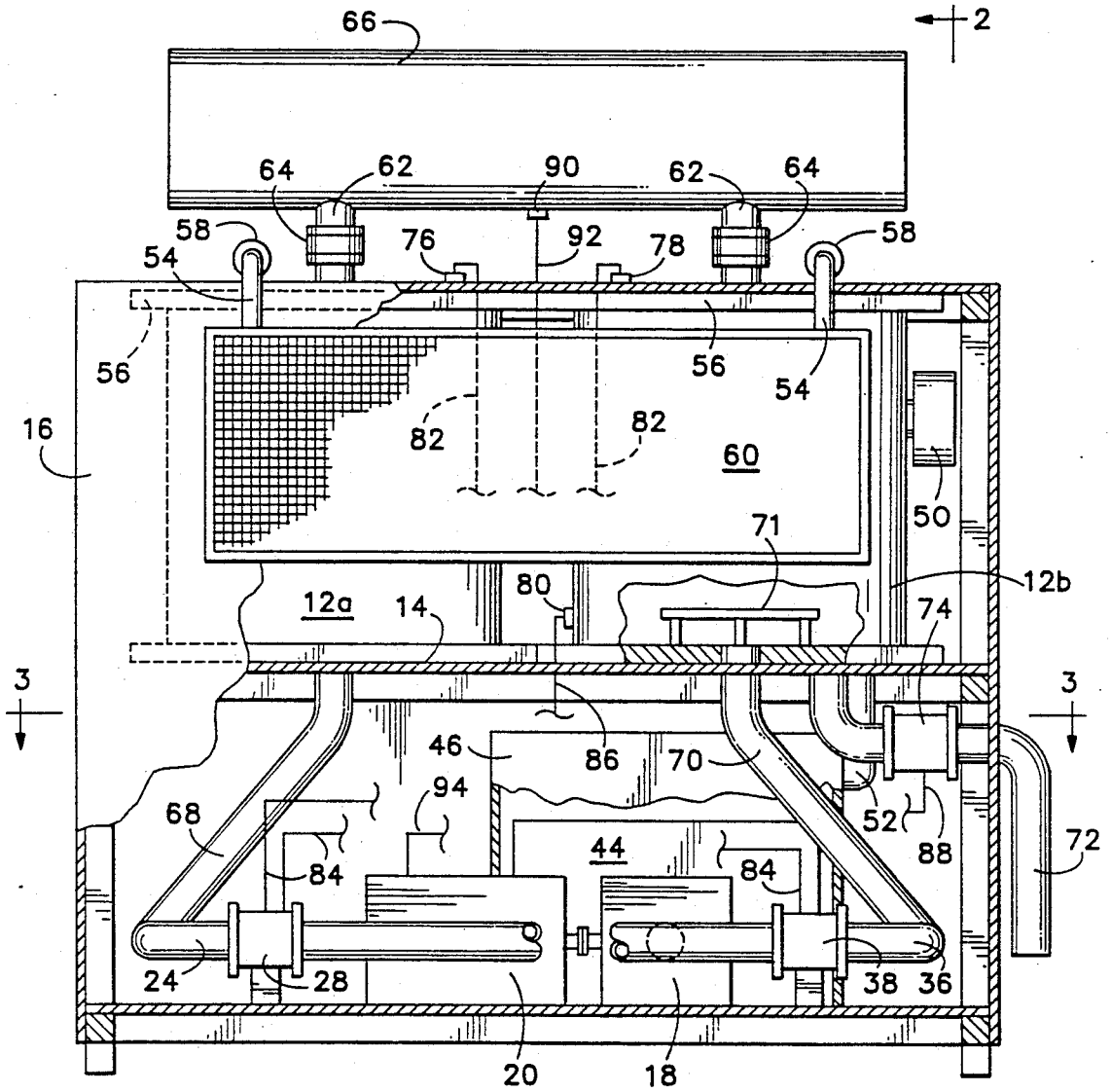
FIG. 1 is a side elevation view, partially broken away to show hidden detail, of a compressor embodying the features of the subject invention.
Figure 3:
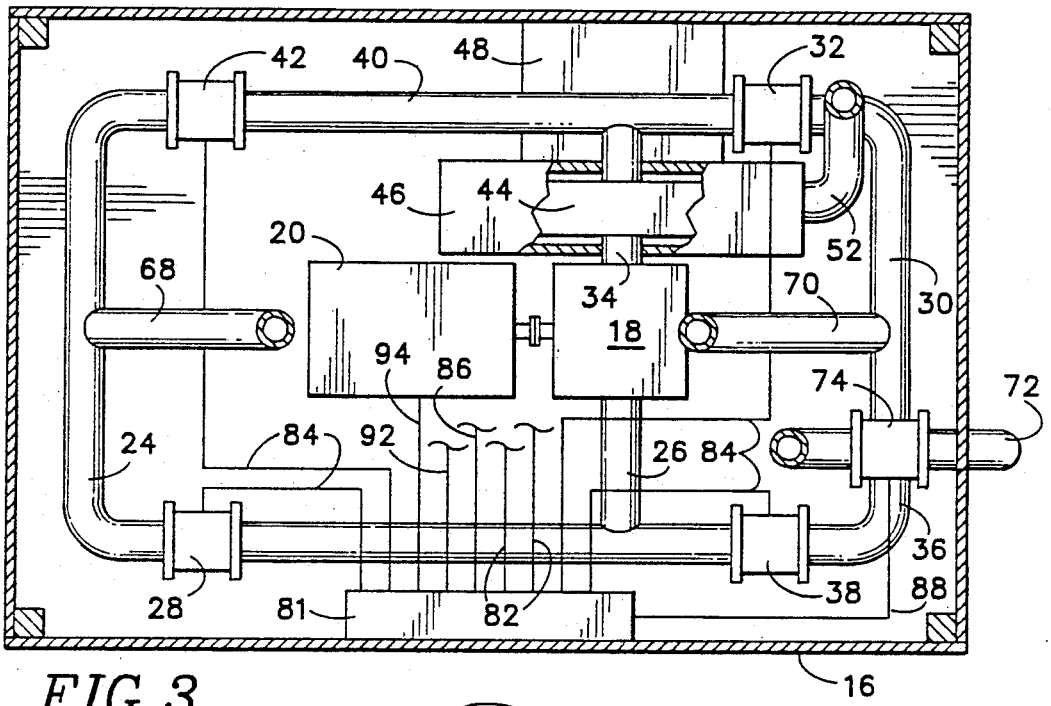
FIG. 3 is a sectional view taken along the line 3—3 of FIG. 1.
Figure 2:
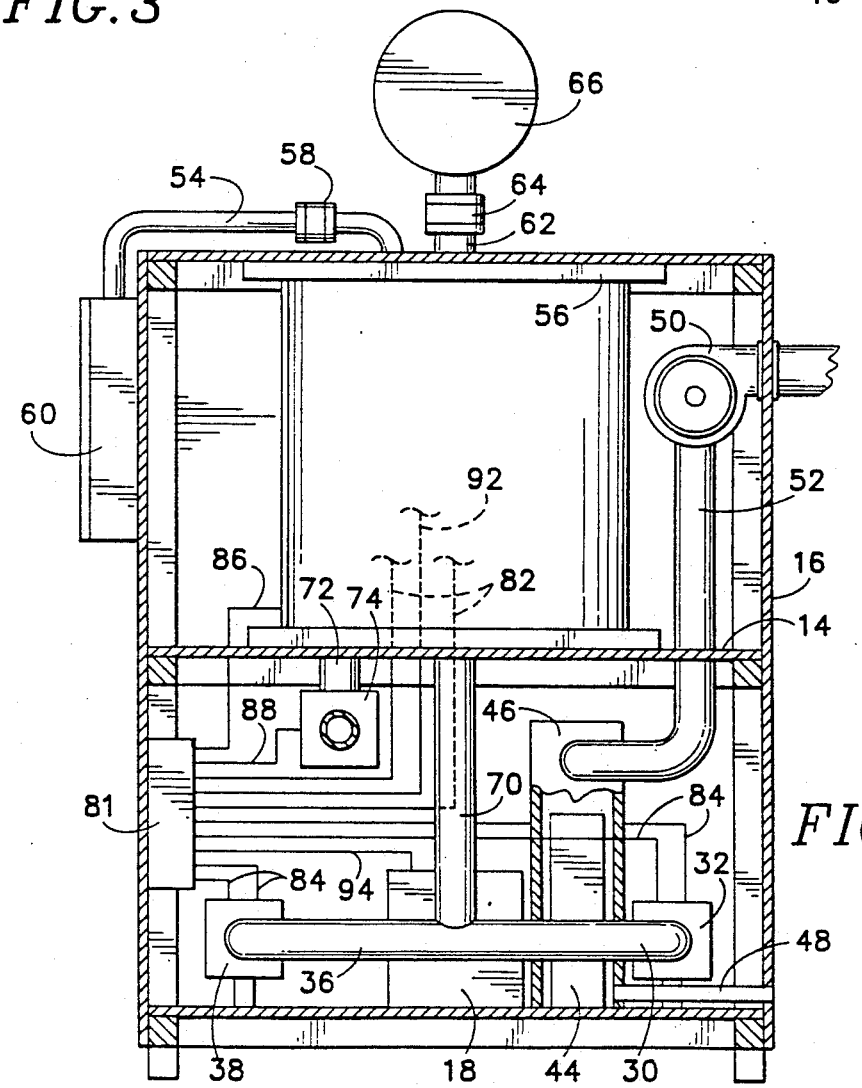
FIG. 2 is a sectional view taken along the line 2—2 of FIG. 1.

Referring now to FIGS. 1, 2 and 3 of the drawings, the compressor of the present invention comprises a pair of hollow chambers 12*a* and 12*b*, which are illustrated as being upright cylinders. In the embodiment illustrated, the chambers 12*a* and 12*b* are mounted on a raised shelf 14 of a rectangular container 16 in order to provide an aesthetically pleasing package. A rotary pump 18, that is driven by a motor 20, is utilized to pump transfer fluid 22 (FIGS. 4–11) between the two chambers through a conduit system. The transfer fluid can be any noncompressible fluid, however, for the reasons set forth below, it preferably is a fluid that is miscible with water.

The conduit system through which the transfer fluid is pumped includes a first conduit 24, which extends between the first chamber 12*a* and an outlet conduit 26 that is connected to the outlet side of the pump 18. The first conduit 26 has a first valve 28 located in it. A second conduit 30, having a second valve 32 located in it, extends between an inlet conduit 34 that is connected to the inlet side of the pump 18, and the second chamber 12*b*. A third conduit 36, having a third valve 38 located in it, extends between the second chamber 12*b* and the outlet conduit 26, and a fourth conduit 40, having a fourth valve 42 located in it, extends between the inlet conduit 34 and the first chamber 12*a*. Thus, when the first and second valves 28 and 32 are open and the third and fourth valves 38 and 42 are closed, the pump 18 draws transfer fluid out of the second chamber 12*b* and pumps it into the first chamber 12*a*. Conversely, when the first and second valves are closed and the third and fourth valves are open, the pump draws fluid out of the first chamber and pumps it into the second chamber. The valves 28, 32, 38 and 42 are remotely controlled solenoid operated valves, such as gate valves, that are movable between full open and full closed positions.

The first and fourth conduits are shown in the drawings as entering the bottom of the first cylinder through a first stand pipe 68, and the second and third conduits are shown as entering the bottom of the second cylinder through a second stand pipe 70. However, all that is required is that the conduits open into the respective chamber at its lowest level. Located in each cylinder 12*a*, 12*b* above the respective stand pipe 68, 70 is a baffle plate 71. The baffle plate prevents a vortex from forming above the stand pipe when transfer fluid is drawn out of a cylinder and thus causing cavitation in the pump 18.

Also entering into the second chamber 12*b* at its lower level is a bleed conduit 72 which has a fifth valve 74 located in it. The fifth valve also is a remotely controlled solenoid actuated valve. Located in the inlet conduit 34 is a heat exchanger 44 that is used to cool the transfer fluid while it is being pumped between the chambers 12*a* and 12*b*. The heat exchanger is a conventional device that is readily available. It can either be air cooled, as illustrated, or water cooled, depending on the size of the compressor and the type of transfer fluid being used. In the embodiment illustrated the heat exchanger 44 is enclosed in a case 46 which receives ambient cooling air through a duct 48. A fan 50 is used to pass the cooling air through the heat exchanger, and a duct 52 collects the heated cooling air and passes it out of the compressor where it can be used as a source of heat.

Each of the chambers 12*a* and 12*b* has a compressible fluid inlet line 54 entering its top 56. The inlet lines 54 have one-way check valves 58 located in them which permit fluid to enter the chambers but not flow back out of them. The compressor illustrated is an air compressor, and thus the compressible fluid is ambient air. Because ambient air often is dirty, a filter 60 is provided to remove contaminants from the air before it is drawn into the compressor. Also entering each chamber through its top 56 is a compressible fluid outlet 62 having a one-way check valve 64 located in it. The compressible fluid outlets terminate in a storage tank 66 that is designed to hold pressurized fluid. While the compressible fluid inlets and outlets enter the chambers through their tops, this is not necessary and all that is required is that they open into the cylinders at their highest level.

A first fluid level sensor 76 is located at the highest fluid level in the first chamber 12*a*, and a second fluid level sensor 78 is located at the highest fluid level in the second chamber 12*b*. A third fluid level sensor 80 is located a predetermined distance above the bottom of the second chamber. The first and second level sensors 76 and 78 are activated when their respective chambers are completely filled with transfer fluid. When activated they annunciate a microprocessor 81, with which they are in electrical communication through lines 82. The microprocessor is also in electrical communication with the valves 28, 32, 42 and 38 through lines 84, and it is programmed to cause the first and second valves 28 and 32 to close and the third and fourth valves 38 and 42 to open when it is annunciated by the first level sensor 76. Conversely, the microprocessor is programmed to cause the first and second valves to open and third and fourth valves to close when it is annunciated by the second level sensor 78.

The third level sensor 80 is activated when the transfer fluid in the second chamber 12*b* reaches the predetermined level. When activated the third level sensor annunciates the microprocessor 81 through a line 86. The microprocessor is in communication with the fifth valve 74 through a line 88, and when it is annunciated simultaneously by the first level sensor 76 and the third level sensor 80 it causes the fifth valve 74 to open and remain open for a predetermined time interval. Otherwise the fifth valve remains closed.

A pressure sensor 90, located in the storage tank 66, is in communication with the microprocessor through a line 92. When the pressure in the storage tank exceeds a designated level, the microprocessor signals the pump motor 20 through a line 94 to cause it to discontinue operation. When the pressure in the storage tank drops below a second designated level, the microprocessor causes the motor to restart.

Figure 4:
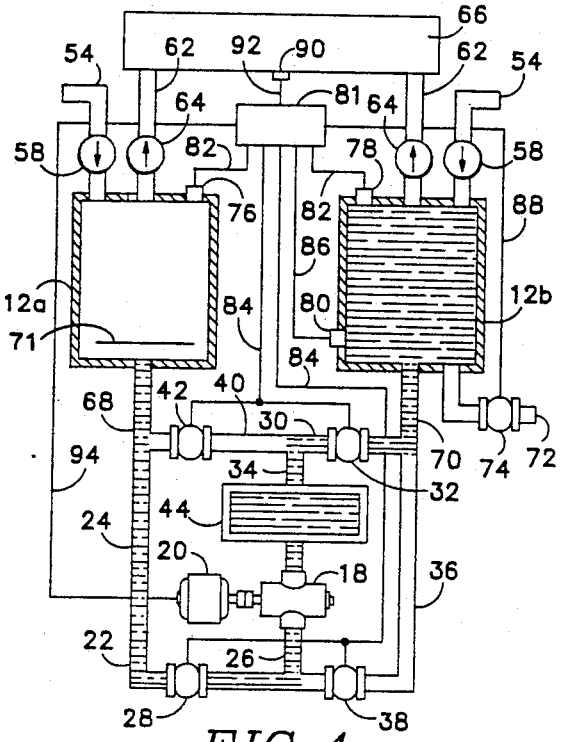
FIGS. 4–11 are diagramatic views showing the operation of the compressor of the subject invention.
Figure 5:
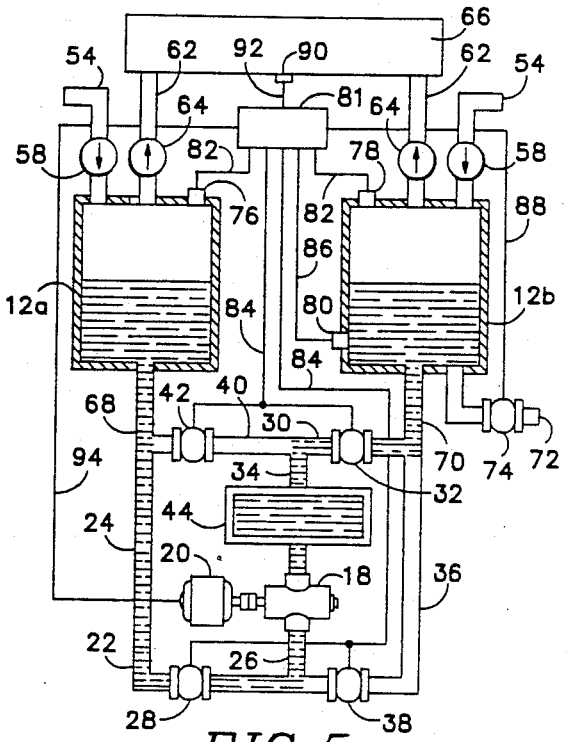
Figure 6:
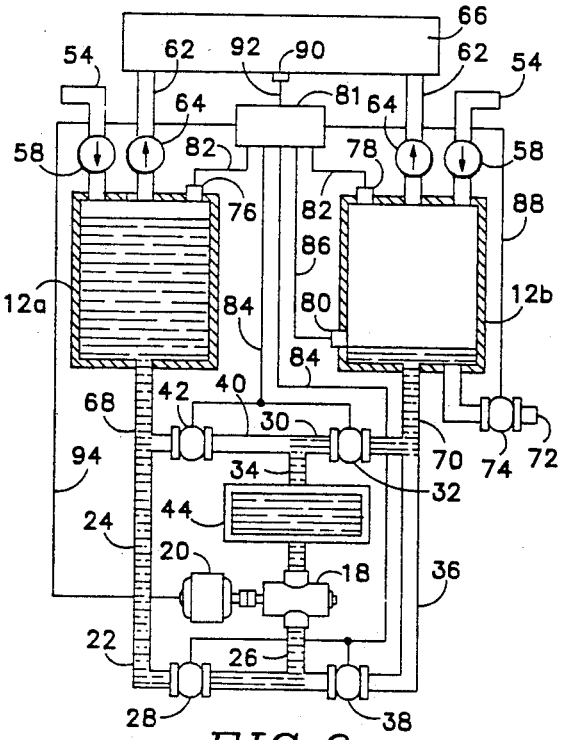

In operation, one of the chambers 12*a*, 12*b* and the entire conduit system are filled with transfer fluid. Preferably, approximately 5% extra transfer fluid is placed in the compressor to prevent cavitation as the chambers become empty. The compressor is then activated by starting operation of the motor 20 to drive the pump 18. The sequence of operation of the compressor is shown schematically in FIGS. 4–9. FIG. 4 shows the first chamber 12*a* completely empty of transfer fluid and the second chamber 12*b* completely full of transfer fluid. While this would not normally be the status of the compressor when it is started, as will be more fully set forth below, it does facilitate explanation of the operation of the device. Since the second chamber 12*b* is full of transfer fluid, the second level sensor 78 is activated and the microprocessor causes the first and second valves 28, 32 to be open and the third and fourth valves 38, 42 to be closed. Thus, transfer fluid is pumped out of the second chamber 12*b* and into the first chamber 12*a* as shown in FIGS. 5 and 6. As the transfer fluid fills the first chamber the air in the chamber is compressed and is forced through the compressible fluid outlet 62 into the storage tank 66. The check valve 58 prevents the compressed air from leaving the cylinder through the compressible fluid inlet 54. As the transfer fluid flows out of the second chamber 12*b* it pulls ambient air into the second chamber through the compressible fluid inlet 54. The check valve 64 prevents air from being drawn into the chamber 12*b* through the compressible fluid outlet 62.

Figure 7:
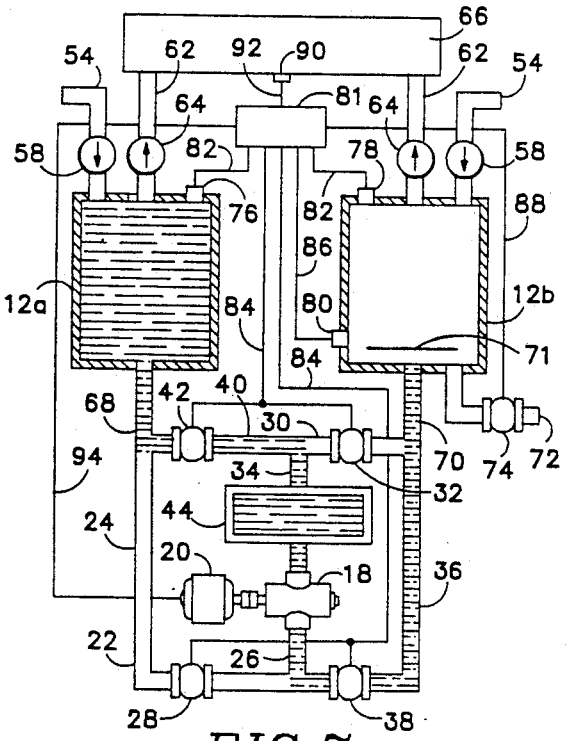
Figure 8:
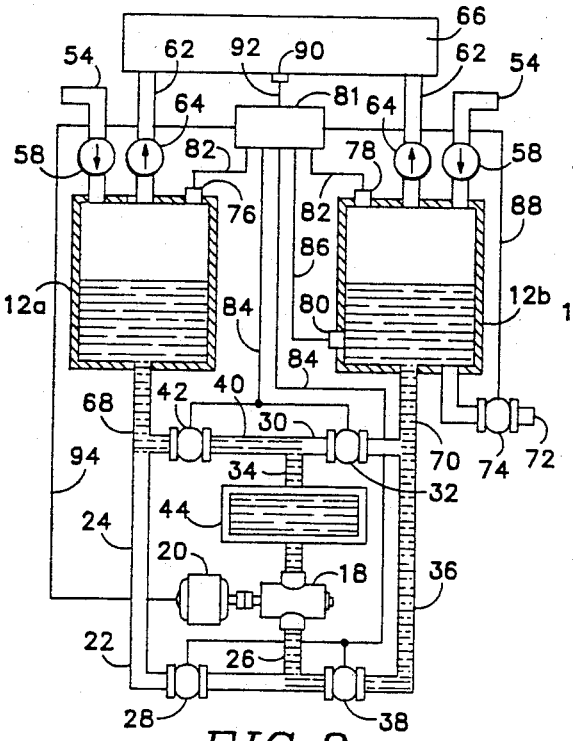
Figure 9:
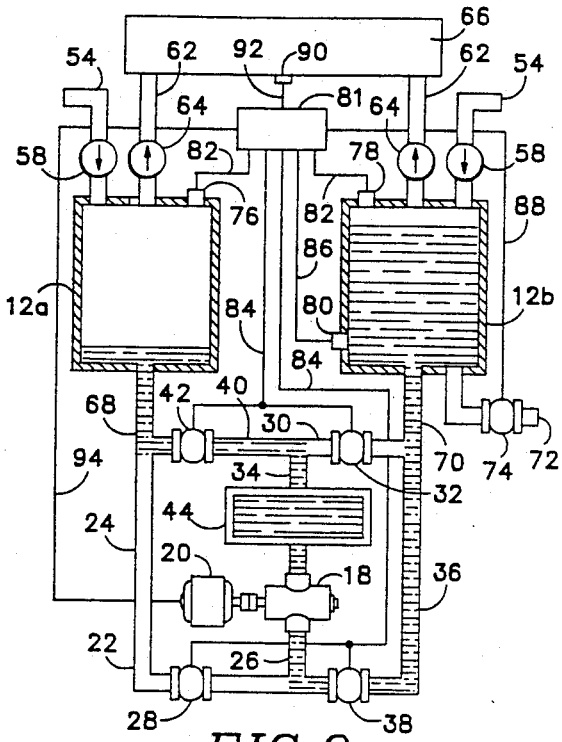

When all of the transfer fluid has been transferred from the second chamber 12*b* to the first chamber 12*a*, FIG. 7, the first sensor 76 is activated and the microprocessor causes the first and second valves 28, 32 to close and the third and fourth valves 38, 42 to open. Fluid then is drawn back out of the first chamber and pumped into the second chamber, FIGS. 8 and 9. As transfer fluid fills the second chamber the air in that chamber is compressed and is forced through the compressible fluid outlet 62 into the storage tank 66. The check valve 58 prevents the compressed fluid from leaving the second cylinder through the compressible fluid inlet 54. As the transfer fluid flows out of the first chamber 12*a*, ambient air is pulled back into the first chamber through the compressible fluid inlet 54. The check valve 64 prevents air from being drawn into the chamber 12*a* through the compressible fluid outlet 62.

When all of the transfer fluid has been transferred back into the second chamber 12*b* (FIG. 4), the second sensor 78 is activated causing the microprocessor to again reverse the position of the first, second, third and fourth valves and the cycle is started over again.

During operation of the compressor, moisture is condensed out of the ambient air drawn into the chambers as the air is compressed. If the transfer fluid is mixable with water, as is preferred, this moisture is absorbed by the transfer fluid and the volume of transfer fluid gradually increases. When the volume of transfer fluid becomes sufficient that transfer fluid remains above the level of the third sensor 80 in the second chamber when the first chamber is full, the first sensor 76 and the third sensor 80 are simultaneously activated, and the microprocessor opens the fifth valve 74 for a predetermined time, which is long enough to allow the excess transfer fluid to be pumped out of the system through the bleed conduit 72.

Figure 10:
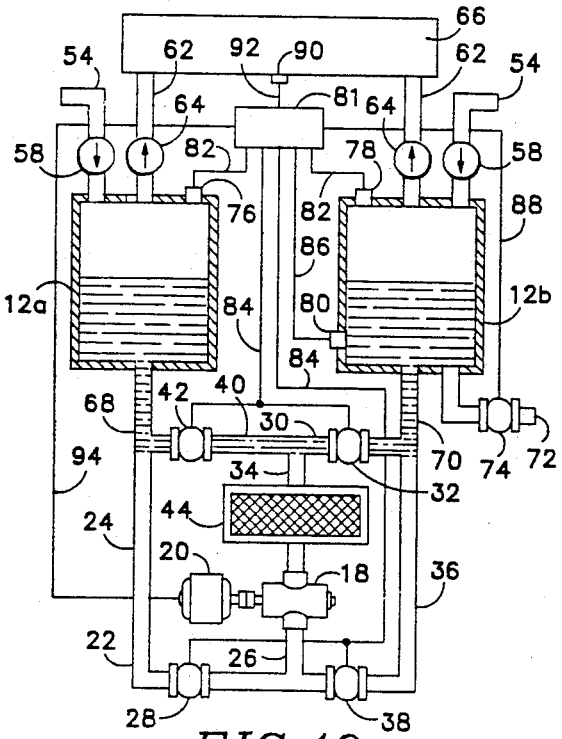
Figure 11:
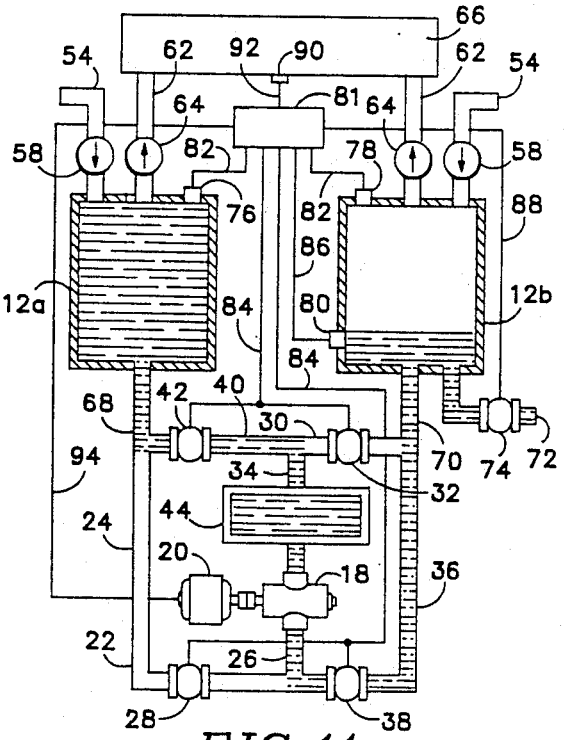

When the air in the storage tank reaches a predetermined pressure, the pressure sensor 90 is activated and the microprocessor stops operation of the motor 20. The microprocessor also causes the second and fourth valves 32, 42 to open and the first and third valves 28, 38 to close, the transfer fluid equalizes between the chambers 12*a* and 12*b*, as shown in FIG. 10. As a result, when the pressure in the storage tank drops and the pump is restarted, there is no hydraulic head to overcome. Since all of the change in head created during the partial compression cycle before shutdown is saved, it is not necessary to bleed any air out of the chamber in which air was being compressed to facilitate start-up and no compressed air is lost.

Because the subject compressor uses the transfer fluid as its pistons, rather than having solid elements as the prior art compressors do, piston clearance does not have to be provided to accommodate expansion, and the entire volume of air drawn into the cylinders can be compressed. In addition, because the transfer fluid is cooled by the heat exchanger 44 when it is outside of the chambers, the compressor can be kept much cooler.

As a result, air drawn into the chambers is not heated to as high of a temperature and it has greater density. Both of these features cause the subject pump to have a significantly higher volumetric efficiency than is possible with solid compression element pumps.

In addition, the condensate which is formed from moisture in the air being compressed entraps microscopic particles which are too small to be removed by the air filter 60. These particles are absorbed into the heat transfer fluid along with the condensed moisture thereby making the air cleaner than is possible with the prior art pumps.

Also, since there are no solid pistons which suddenly are decelerated at the end of each stroke, lubricating oil is not thrown off of the pistons onto the outlet ports where it is entrapped in the compressed air flowing out of the chambers.

Finally, due to the fact that there are less moving parts in the subject pump than in prior art pumps, and there is no violent direction reversal of moving parts, wear is far less and maintenance costs are reduced.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A compressor comprising:

(a) a pair of hollow chambers;

(b) conduit means for fluidly interconnecting said pair of chambers;

(c) a noncompressible transfer fluid having a volume which completely fills one of said chambers and said conduit means;

(d) pump means associated with said conduit means for pumping said transfer fluid between said chambers;

(e) means for reversing the direction said transfer fluid is being pumped each time one of said chambers becomes filled with said transfer fluid;

(f) compressible fluid inlet means associated with each of said chambers for permitting nonpressurized compressible fluid to be drawn into a respective one of said chambers when said transfer fluid is being pumped therefrom, and preventing the escape of said compressible fluid from said respective one of chambers when transfer fluid is being pumped therein;

(g) compressible fluid outlet means associated with each of said chambers for permitting compressible fluid to be pumped out of a respective one of said chambers when transfer fluid is being pumped therein, and preventing the compressible fluid which has been pumped out of said chamber from flowing back therein when said transfer fluid is being pumped therefrom;

(h) storage means fluidly connected to said compressible fluid outlet means for storing pressurized compressible fluid; and (i) bleed means for draining transfer fluid from said apparatus when the volume of said transfer fluid

2. A compressor comprising:

(a) a pair of hollow chambers;

(b) a noncompressible transfer fluid having a volume which completely fills one of said chambers and said conduit means;

(c) a rotary pump having a fluid inlet conduit and a fluid outlet conduit connected thereto;

(d) a first conduit extending between a first of said chambers and said outlet conduit, said first conduit having a first valve located therein;

(e) a second conduit extending between the second of said chambers and said inlet conduit, said second conduit having a second value located therein;

(f) a third conduit extending between said second of said chambers and said outlet conduit, said third conduit having a third valve located therein;

(g) a fourth conduit extending between said first of said chambers and said inlet conduit, said fourth conduit having a fourth valve located therein;

(h) a first level sensor which is activated when said first of said chambers is filled with transfer fluid;

(i) a second level sensor which is activated when said second of said chambers is filled with transfer fluid;

(j) a microprocessor which is annunciated by said first and second level sensors and operates said first, second, third and fourth valves;

(k) said microprocessor being programmed to cause said first and second valves to open and said third and fourth valves to close when annunciated by said first level sensor, and to cause said first and second valves to close and said third and fourth valves to open when annunciated by said second level sensor;

(l) compressible fluid inlet means associated with each of said chambers for permitting nonpressurized, compressible fluid to be drawn into a respective one of said chambers when transfer fluid is being pumped therefrom, and preventing escape of said compressible fluid from said respective one of said chambers when transfer fluid is being pumped therein;

(m) compressible fluid outlet means associated with each of said chambers for permitting compressible fluid to be pumped out of a respective one of said chambers when transfer fluid is being pumped therein, and preventing the compressible fluid which has been pumped out of said chamber from flowing back therein when said transfer fluid is being pumped therefrom;

(n) storage means fluidly connected to said compressible fluid outlet means for storing pressurized compressible fluid; and (o) a bleed system comprising;

(i) a bleed outlet in said second chamber at the lowermost level thereof;

(ii) a fifth valve fluidly associated with said bleed outlet;

(iii) a third level sensor which is activated when said second chamber is filled to a predetermined level, said third level sensor annunciating said microprocessor; and (iv) said microprocessor being programmed to cause said fifth valve to open only when simultaneously annunciated by said first and third level sensors.

3. The compressor of claim 2 wherein said microprocessor is programmed to cause said fifth valve to remain open for a predetermined time interval once it is opened.

* * * * *

UNITED STATES PATENT AND TRADEMARK OFFICE

CERTIFICATE OF CORRECTION

PATENT NO. : 5,073,090

DATED : December 17, 1991

INVENTOR(S) : Joseph C. Cassidy

It is certified that error appears in the above-identified patent and that said Letters Patent is hereby corrected as shown below:

Col. 7, Line 66 : after transfer fluid add -- exceeds the combined volume of one of said chambers and said conduit means. --

Signed and Sealed this

Seventh Day of September, 1993

Bruce Lehman

*Attest:*

BRUCE LEHMAN

*Attesting Officer*

*Commissioner of Patents and Trademarks*